US008424232B2

(12) United States Patent
Michel

(10) Patent No.: US 8,424,232 B2
(45) Date of Patent: Apr. 23, 2013

(54) CONVERTIBLE HANG TAG AND METHOD FOR USE THEREOF

(76) Inventor: Joyce Michel, New York, NY (US)

( * ) Notice: Subject to any disclaimer, the term of this patent is extended or adjusted under 35 U.S.C. 154(b) by 239 days.

(21) Appl. No.: 12/814,081

(22) Filed: Jun. 11, 2010

(65) Prior Publication Data

US 2011/0303559 A1 Dec. 15, 2011

(51) Int. Cl.
*G09F 3/10* (2006.01)

(52) U.S. Cl.
USPC ..... 40/672; 206/299; 40/124.06; 40/661.04

(58) Field of Classification Search ..... 40/672, 40/124.06, 661.04; 206/299; 229/195
See application file for complete search history.

(56) References Cited

U.S. PATENT DOCUMENTS

| | | | | | |
|---|---|---|---|---|---|
| 888,201 | A * | 5/1908 | Strauss | 206/216 |
| 1,138,788 | A * | 5/1915 | Puley | 229/109 |
| 1,201,054 | A * | 10/1916 | Johnston | 206/760 |
| 1,975,804 | A * | 10/1934 | Seifer | 206/216 |
| 2,108,343 | A * | 2/1938 | McAllister | 229/75 |
| 4,620,630 | A * | 11/1986 | Moss | 206/45.24 |
| 2003/0217488 | A1 * | 11/2003 | Chmiel et al. | 40/124.19 |
| 2004/0244252 | A1 * | 12/2004 | Phinney | 40/665 |
| 2008/0250689 | A1 * | 10/2008 | Cohen | 40/664 |
| 2010/0011634 | A1 * | 1/2010 | Dweck et al. | 40/124.06 |

* cited by examiner

*Primary Examiner* — Joanne Silbermann
*Assistant Examiner* — Kristina Junge
(74) *Attorney, Agent, or Firm* — DLA Piper LLP (US)

(57) ABSTRACT

I provide a hang tag, preferably used for a saleable item such as clothing, that is convertible into a storage container. The storage container can then be used to store the purchased item. In a method of use, a user can remove the hang tag from a recently purchased saleable item of clothing, and, through a series of folds and interlocking of panels, create the storage containers in which the user could place the item.

19 Claims, 14 Drawing Sheets

Square I Closed

Open | Opened | Flat

Open | Closed

CONVERTIBLE HANG TAG AND METHOD FOR USE THEREOF

TECHNICAL FIELD

This disclosure generally relates to a device that can convertibly be used as a hang tag for an item and a container for the item.

BACKGROUND

Many items for sale, in particularly clothing items, utilize hang tags as a way to convey information about the item the tag is hanging from. Hang tags on garments today are usually used to convey information about a product including, but not limited to, a brand name, description of the garment, garment benefits, size information, price, fabric content, care instructions, marketing information, where the garment was manufactured, and distribution information. These hang tags are disposable and are not kept by the consumer. Hangs tags known in the art generally do not have any other purpose than to convey information such as listed above.

The items that the hang tags are attached to are typically stored somewhere after purchase. Most typically, this requires use of a dresser or similar furniture piece. Drawers can be messy with many small items. Drawer organizers are helpful but expensive. Moreover, the purchaser may be at an atypical location where they do not have access to their home storage areas or any storage areas at all. In these situations, a storage area can be separately purchased for the item, but the portability and disposability of such storage areas are lacking. Additionally, in today's world of being more ecologically friendly, re-purposing of any printed matter is important. Disposing of an item when it can serve a valuable purpose for the end user such as drawer organization is hot environmentally efficient.

Therefore, a need exists in the art for hang tags that are utilized for reasons other than the display of information. There is a further need for such a device that provides an immediate and portable storage area for the purchased item and that can serve as a drawer organizer.

SUMMARY

I solve these needs and provides a novel hang tag with two foldable embodiments and method for using the same. The two foldable embodiments include a hang tag for providing information about an item and a storage area that can be used for the same said item.

This disclosure further contemplates a convertible hang tag formed from a foldable blank, the foldable blank including a front panel having a multiplicity of sides, at least three end panels hingedly attached to the sides of the front panel wherein each end panel includes at least one interlocking mechanism to interlock with an adjacent end panel; at least one front panel aperture in the front panel; and at least one end panel aperture in at least one of the end panels, wherein the at least one end panel aperture overlaps the at least one front panel aperture when the end panel containing the at least one aperture is hingedly folded toward the front panel.

This disclosure further contemplates a convertible hang tag for identification of clothes, including a front panel haying a multiplicity of sides, at least three end panels hingedly attached to the sides of the front panel such that each side is hingedly attached to at least one end panel, and wherein each end panel includes at least one opening and at least one tab extending outwardly from an edge thereof, such that the at least one tab of one panel can interlock with at least one opening of an adjacent panel to form a storage area.

This disclosure further contemplates a method for converting a tag for identifying an item into a container, including the steps of unfolding a tag to provide a front panel having a multiplicity of sides and at least three end panels hingedly attached to the sides of the front panel, and interlocking the end panels together to form a storage area.

BRIEF DESCRIPTION OF THE DRAWINGS

Without restricting the full scope of my disclosure, various preferred forms of the disclosure and its related articles are illustrated in the following drawings.

DETAILED DESCRIPTION

Figure 1:
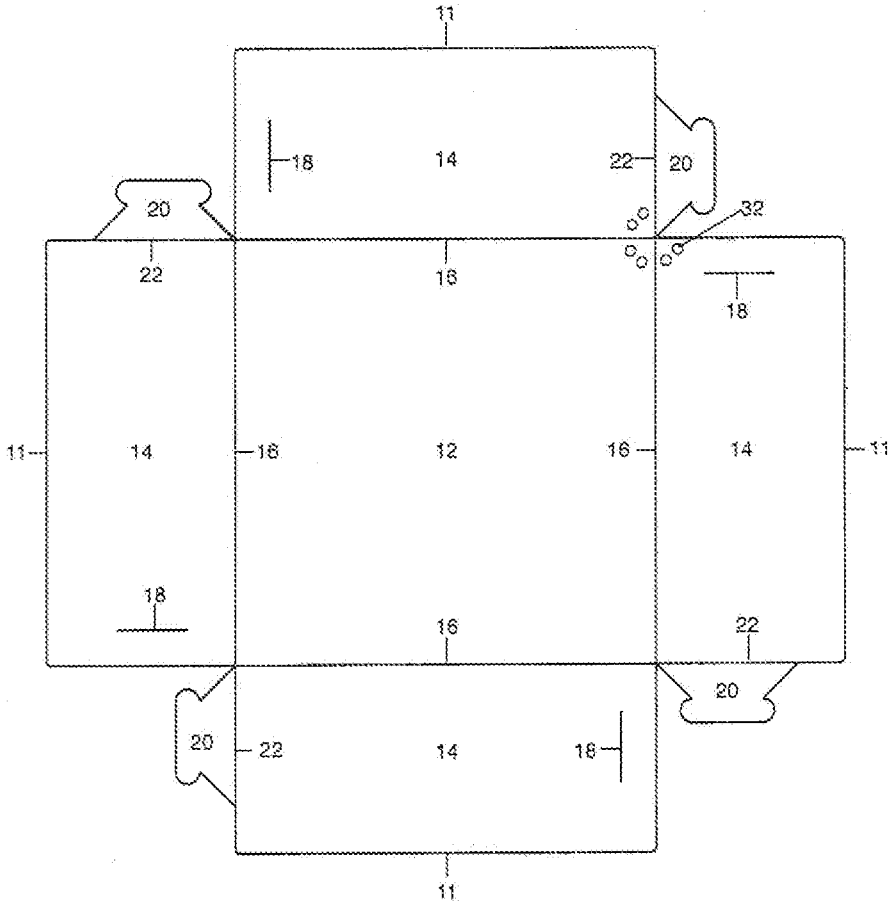
FIG. 1 is a plain view of a hang tag blank having four end panels.

FIG. 1 shows a foldable blank combination device generally designated by reference number 10. As discussed below, blank 10 can be folded into either a tag that can hang off an item, typically a piece of saleable merchandise, or placed into a container for holding the same item. Blank 10 includes front panel 12 and at least three end panels 14 that are hingedly attached to front panel 12. In preferred embodiments, end panels 14 are hingedly attached to front panel 12 along fold lines 16 with outer edges 11 that are at least the same length as fold line 16. In alternate embodiments, end panels can be attached to front panel 14 with other devices, such as binding or laced string, that allow for relative, hinged movement between the front and end panels.

Figure 10:
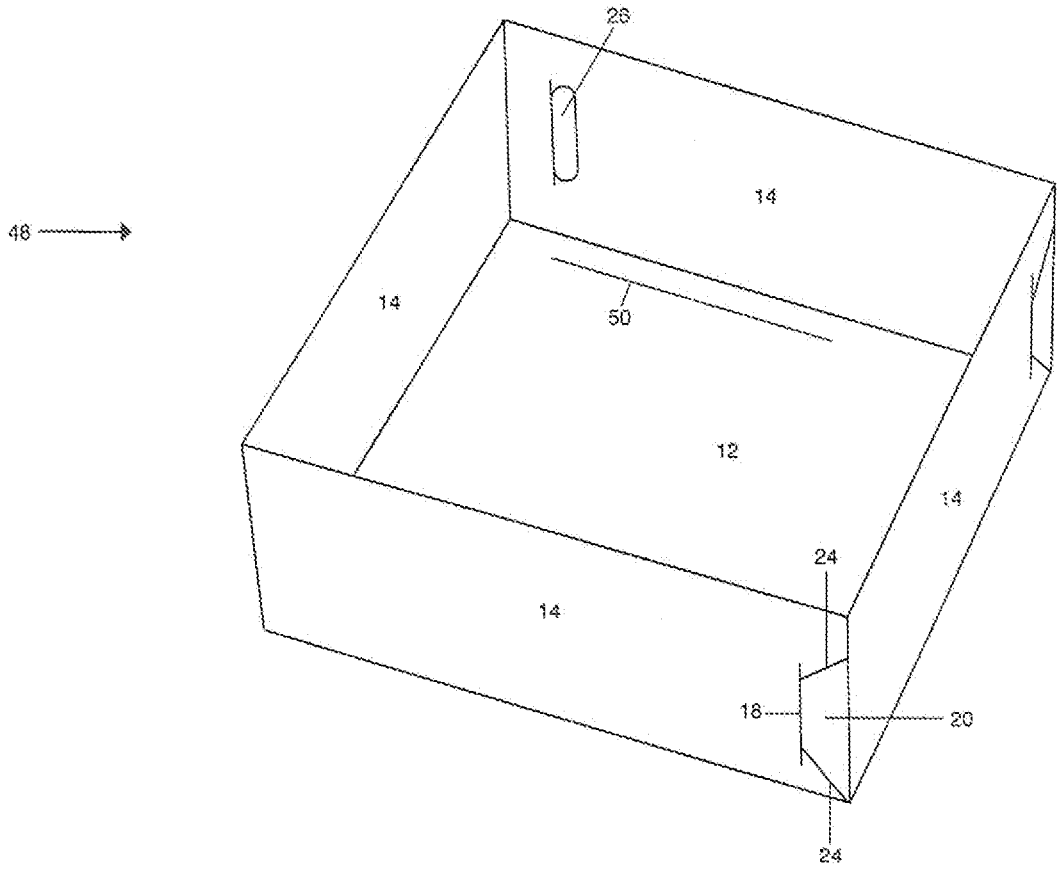
FIG. 10 is a top perspective view of the second folded embodiment.

FIG. 1 shows a preferred embodiment of a symmetrical blank 10 having four end panels of substantially the same size. The number of end panels can vary widely while maintaining the advantages can include substantially any number of sides greater than two. For example, FIG. 10 shows a blank having eight side panels. It will be understood by one skilled in the art that changing the number of end panels will change the shape of the ultimately formed tag or container without substantially changing the functionality. In preferred embodiments, the number of sides of front panel 12 is equal to the number of end panels, as this is the most efficient way to achieve dual foldability. Due to this variety, front panel 12 can be a variety of shapes depending on the number of end panels 14 used. In one preferred embodiment, shown in FIG. 1, front panel 12 is substantially a square shape. At least one aperture 32 is formed in front panel 12. Apertures 32 are used to hang the device from an item in one of the devices functional embodiments. As shown in FIG. 1, blank 10 can include two apertures 32 of circular shape. One skilled in the art could understand, however, that the shape or even the number of apertures can vary within the spirit of my disclosure.

Blank 10 is preferably made of any foldable material known in the art. Most typically, blank 10 would be of a paper material having enough stiffness to enable portions of the blank to be folded in an upward direction. The size of the blank can be increased or decreased in scale as needed.

Figure 2:
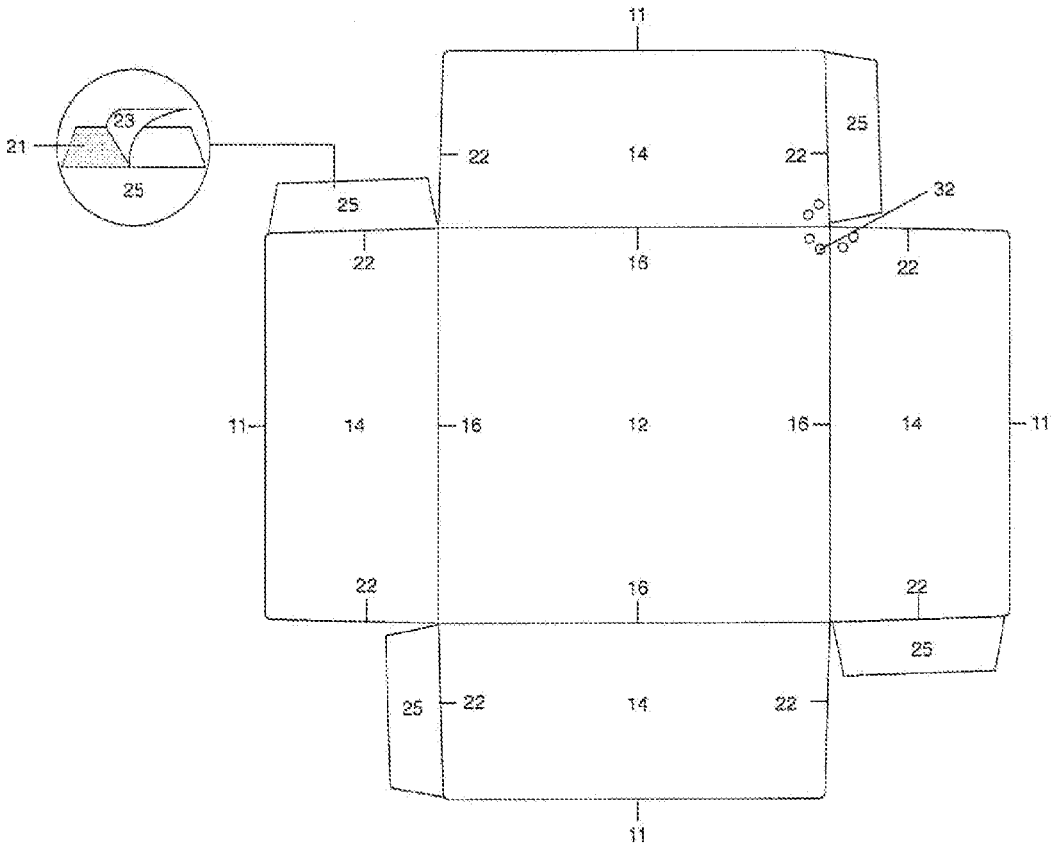
FIG. 2 is a plain view of a second embodiment of the hang tag with adhesive closures.

In preferred embodiments, each end panel includes at least one opening 18 and at least one tab 20 hingedly extending from side 22. For simplicity's sake, the preferred embodiments have each panel including only one opening 18 and only one tab 20 as pictured in FIG. 1. It is conceivable, however, to have multiple tabs and openings on each panel. For example, an end panel 14 could have two tabs substantially next to one another on side 22 and two corresponding openings also next to each other. In alternate embodiments, any interlocking mechanism known in the art can be utilized. For example, as shown in FIG. 2, an alternate interlocking mechanism embodiment comprises a tab 25 that includes a peel away paper 23 on an adhesive strip 21. In the embodiment shown in FIG. 2, end panels 14 do not require openings 18.

Figure 3:
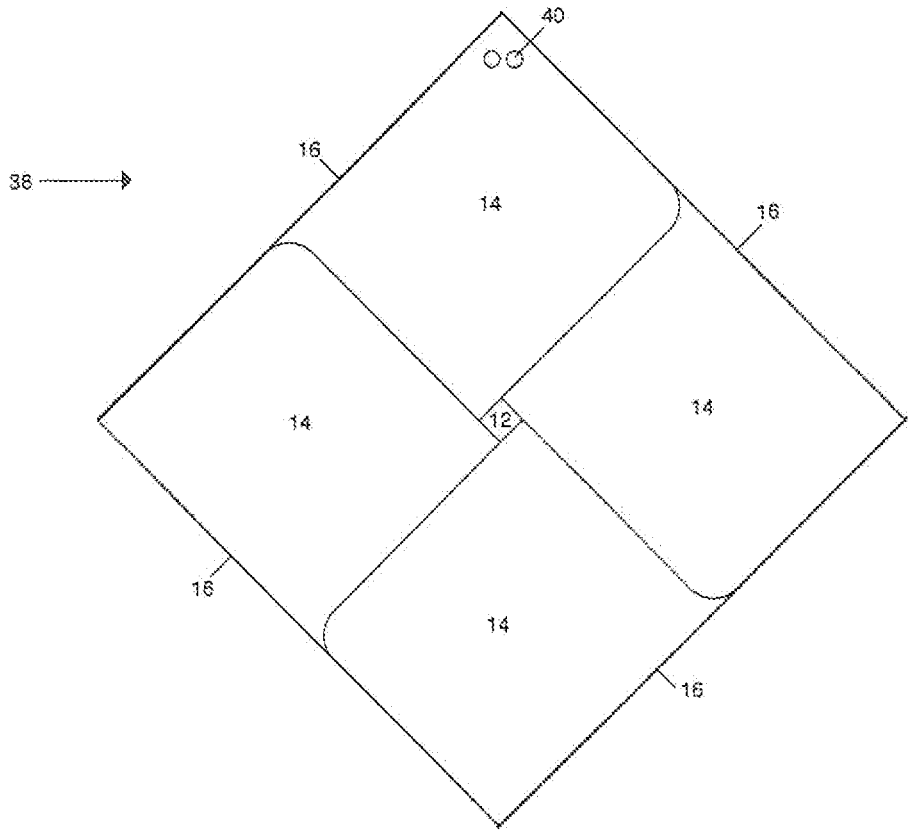
FIG. 3 is a back view of the second folded embodiment of the hangtag.
Figure 4:
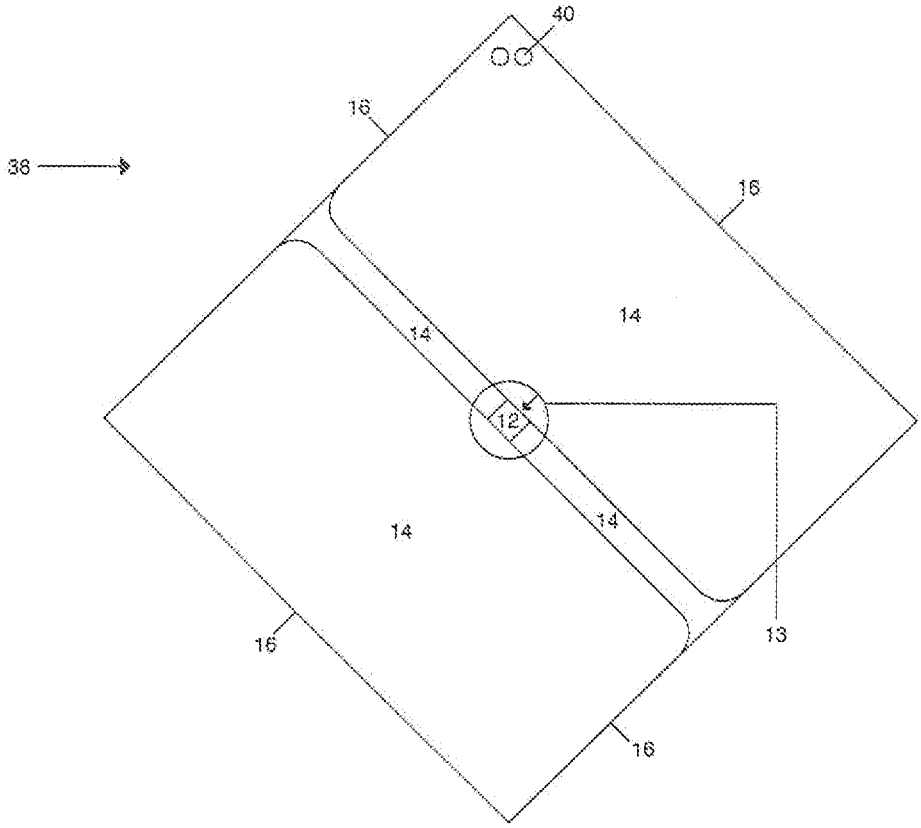
FIG. 4 is a closed view of a first embodiment with a sticker closure.
Figure 5:
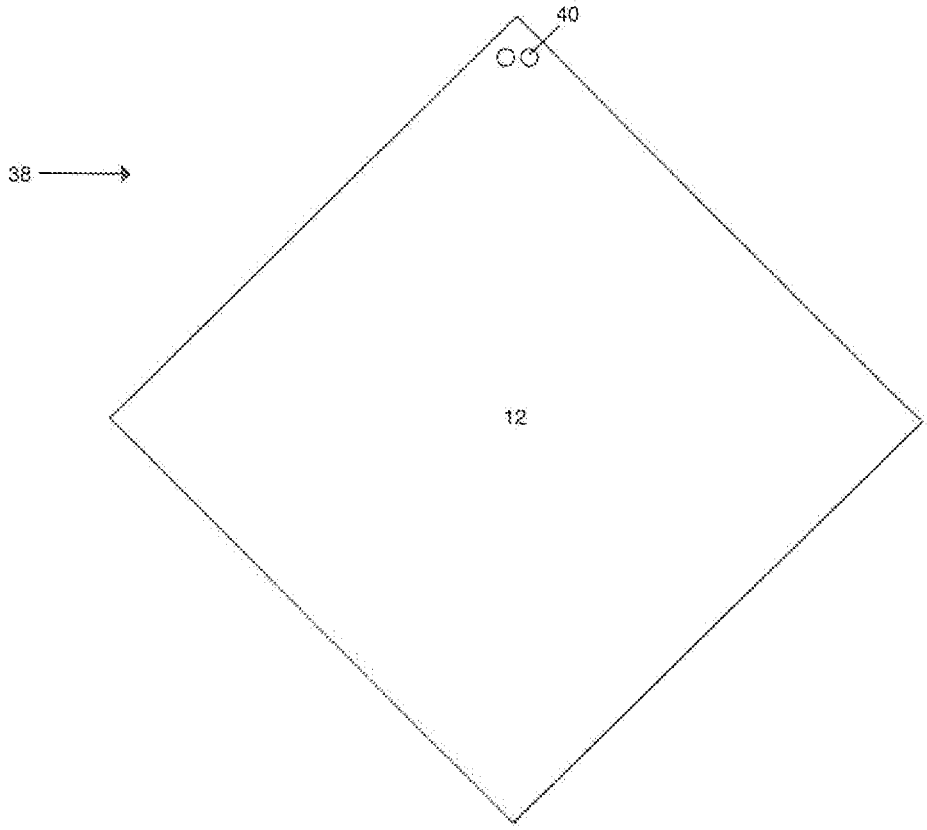
FIG. 5 is a front view of the first folded closed embodiment of the hang tag.

FIGS. 3-5 show a first folding embodiment of blank 10 into tag 38. Each end panel 14 is hingedly moved along fold lines 16 toward front panel 12. The end panels are folded as shown in FIG. 3 such that each end panel partially overlaps a first adjacent end panel and is in turn partially overlapped by a second adjacent panel. The end panels are held in place by the friction and pressure provided by the other end panels. In this foldable embodiments, the panels are not interlocked by openings 18 or tabs 20. Tabs 20 are folded inwardly and are not visible or in use when tag 38 is formed. In another embodiment, shown in FIG. 4, the end panels can also be folded to overlap opposite panels and held in place with a removable sticker 13.

Figure 6:
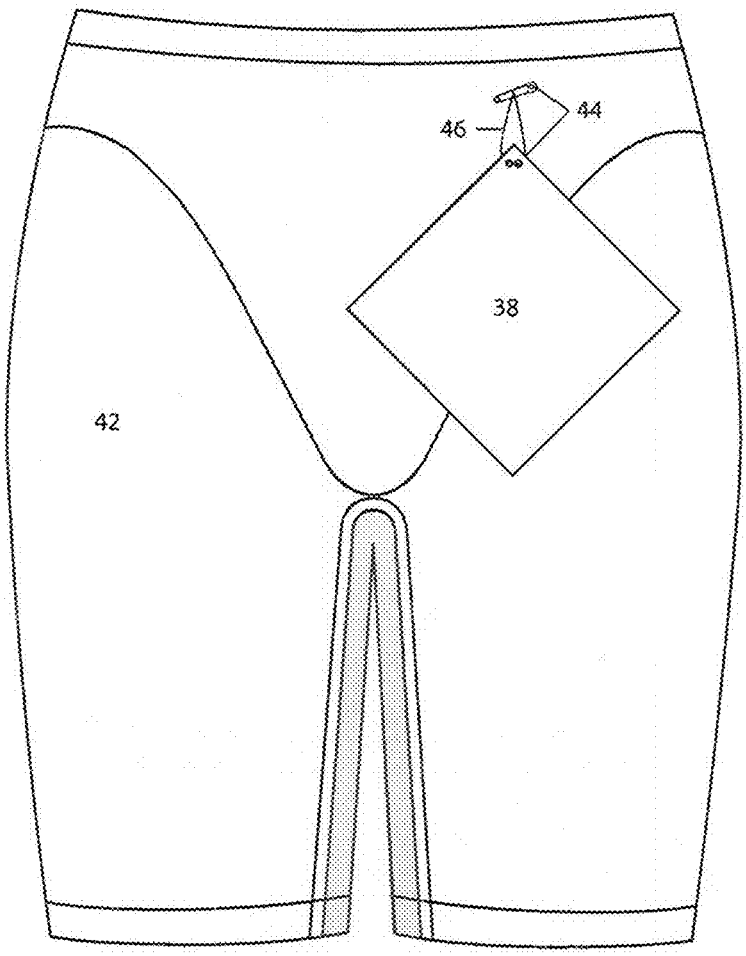
FIG. 6 is a front view of the first folded embodiment on an item.

When the panels are folded into tag 38, the apertures 32 are folded on top of one another such that a deeper aperture 40 is created, having the thickness of one front panel and at least one side panel. As shown in FIG. 3, aperture 40 is visible from the front side of tag 38. FIG. 6 shows tag 38 attached to an item 42. In preferred embodiments, item 42 is a saleable merchandise wherein tag 38 provides identifying information for it. To best take advantage of the features of the box, item 42 is foldable such that it can later fit into the container folded embodiment depicted in FIGS. 8-12. Most typically, this would be a clothing item, one example of which is FIG. 6. In preferred embodiments, the tag is provided on items such as underwear, jock straps, sports bras, bras, athletic apparel, bike shorts, capri pants, shirts, t-shirts, camisoles, shapers, longline underwear, pantyhose, shaping pantyhose, leggings and boy shorts. One skilled in the art would understand, however, that the tag could be used on numerous other products as well.

Tag 38 is attached to item 42 using a fastening device or assembly 44. In preferred embodiments, the tag is attached to the item via at least one aperture in the tag. In these embodiments, fastening assembly 44 includes a pliable material 46 such as a string that is entered through the apertures 40 of tag 38 and a fastener 46 such as a safety pin. As one skilled in the art would understand, however, other types of fastener assemblies could be used with aperture 40 to attach tag 38 to item 42 such as a tag gun.

Figure 7:
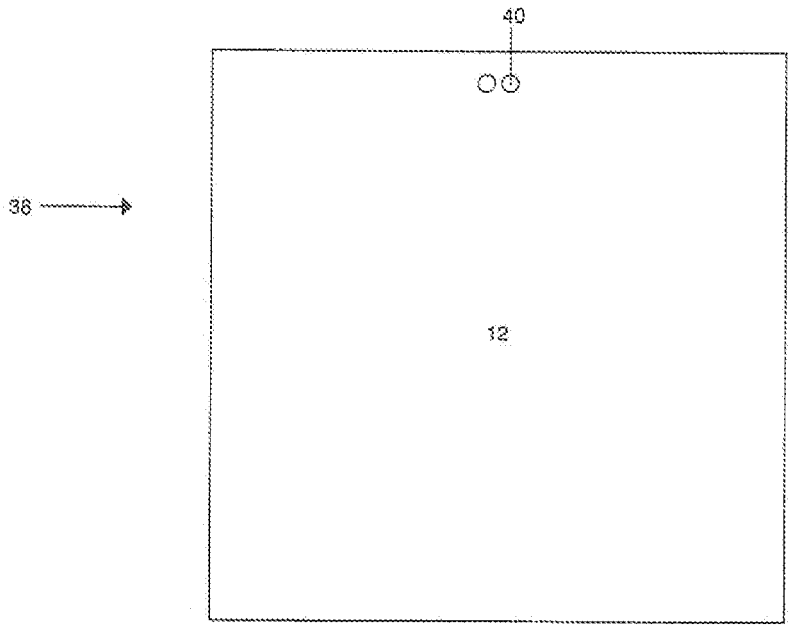
FIG. 7 is a front view of a square first folded embodiment.

In FIG. 7 the visible face of front panel 12 of tag 38 can be imprinted with any type of printing desired. Most typically, this will be identifying information such as a logo of the clothing manufacturer. Tag 38 can also be imprinted with any color or design.

In the embodiment in FIGS. 3-5, apertures 40 are shown in a corner of tag 38. This creates a diamond-shaped tag as it hangs off of item 42, as shown in FIG. 5. In alternate embodiments, apertures 40 can be located in other locations around the tag. One such embodiment is shown in FIG. 7, wherein the apertures 40 are substantially centered along one side of front panel 12. To create this embodiment, apertures 32 of FIG. 1 will have to be located elsewhere on blank 10. This embodiment will create a square tag 38 as it hangs off item 40. As would be readily understood, the apertures can be located elsewhere on the tag other than those locations depicted in FIGS. 1-7.

Figure 8:
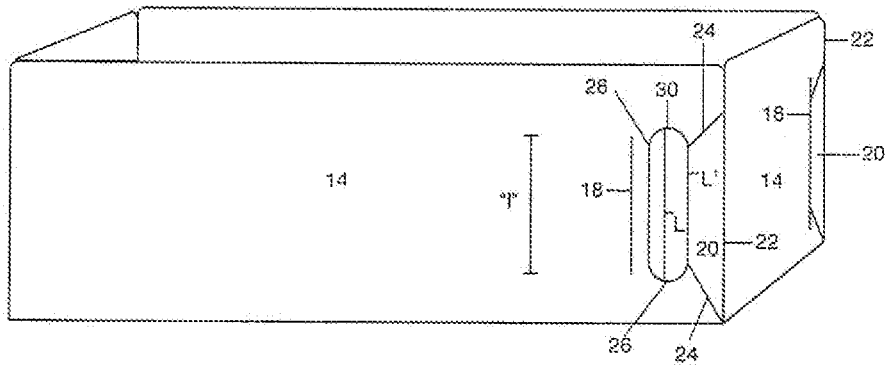
FIG. 8 is a side perspective view of the hang tag blank being folded into a second folded embodiment.

As shown in FIG. 8-11, blank 10 can be folded into a second folding embodiment. As shown in FIG. 8, at least one tab 20 of end panel 14 is entered into an opening 18 of an adjacent end panel 14, thereby interlocking the two adjacent panels together. Each tab extends from side 22 of end panel 14 and is designed to fit into an opening 18 in a substantially adjacent end panel. One skilled in the art will understand that the precise shapes and sizes of tabs 20 and openings 18 can vary widely while still maintaining the same functionality. In preferred embodiments, tabs 20 includes opposing converging sides 24 that converge as tab 20 extends from side 22. Converging sides 24 extend to a crown 26 having a flat top side 28 and rounded sides 30. Rounded sides 30 meet converging sides 24 at two opposing indents 36.

Figure 9:
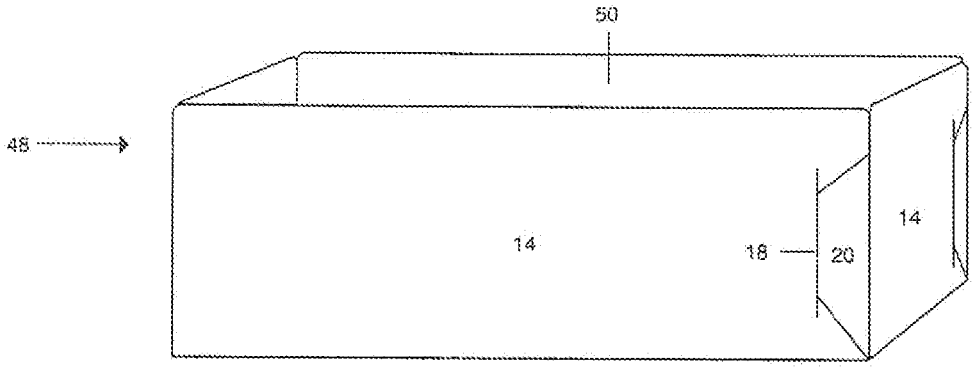
FIG. 9 is a side perspective view of the second folded embodiment.

Opening 18 is preferably a slit through which a portion of tab 20 can fit through, thereby interlocking two adjacent side panels. In this embodiment, a length "1" of opening 18 is smaller than a length "L" of crown 26 but greater than the length "$L^{1}$"" between the converging sides 24. Opening 18 can accept crown 26 if crown 26 is entered on through opening 18 on a suitable angle. After entry, opening 18 can hold crown 26 on one side of the opening while the remainder of tab 20 is on the other side of the opening, thereby interlocking adjacent end panels 14 as shown in FIG. 9.

Each tab 20 is entered into an opening in an adjacent end panel, interlocking the end panels together, until a container 48 is formed. As shown in FIG. 9, completed container 48 provides a storage area 50 into which items can be placed. In preferred embodiments, shown in FIG. 12, the item placed in storage area 50 is the same item 42 to which tag 38 was attached. To this end, a purchaser can buy an item 42 and simultaneously receive a storage container for the item that can be used as needed. This provides a purchaser with an inexpensive, portable and disposable alternative to purchases requiring separate boxes or containers to hold their purchases.

Figure 11:
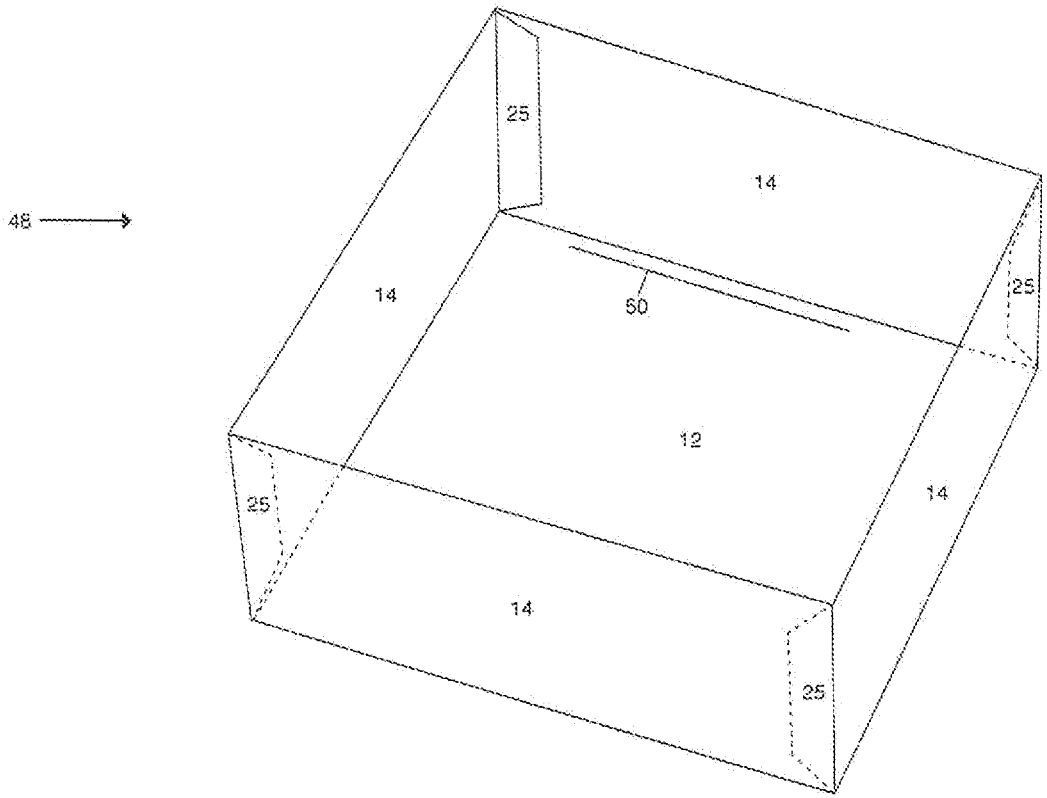
FIG. 11 is a top perspective of a second folded embodiment with adhesive closures.
Figure 12:
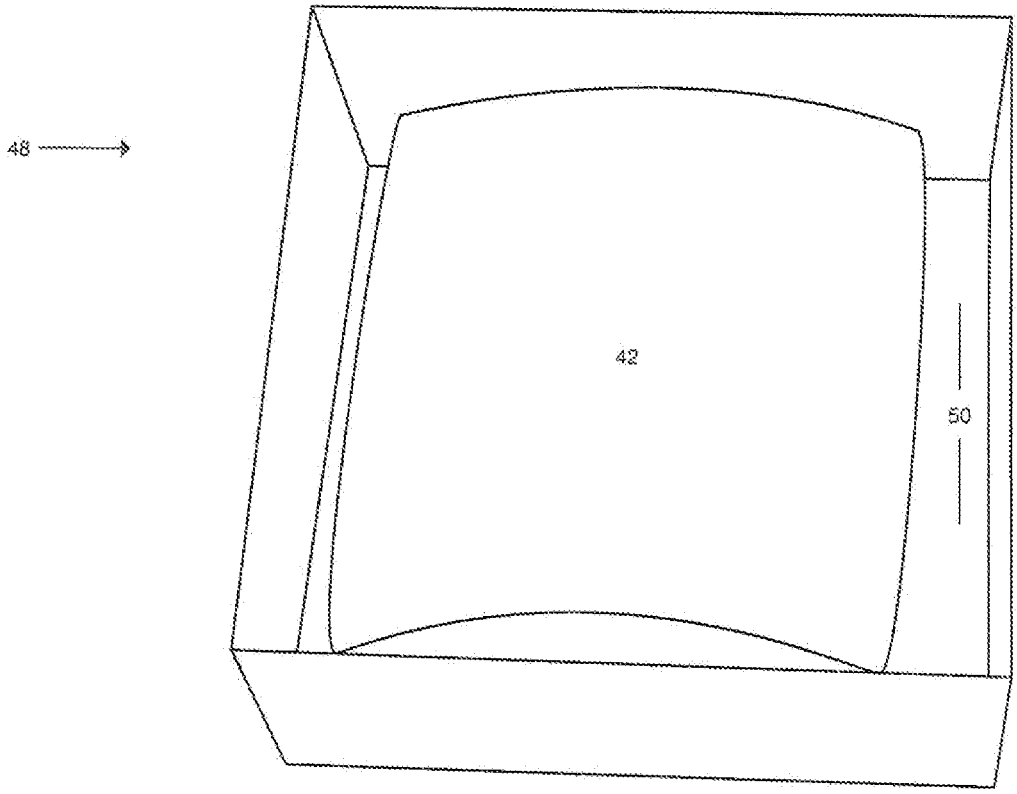
FIG. 12 is a top perspective view of the second folded embodiment containing an item.

FIG. 11 shows an alternate embodiment wherein a container is formed when self adhesive tabs 25 are adhered onto adjacent end panels 14.

I thereby provide a method for storing an item by converting a tag for identifying an item into a storage container for the item. The method includes the steps of unfolding a tag to provide a front panel having a multiplicity of sides and at least three end panels hingedly attached to the sides of the front panel and interlocking the end panels together to form a storage area. The item can thereafter be stored in the storage area. The resulting storage area is also preferably stackable with other like storage areas formed from like tags.

Figure 13:
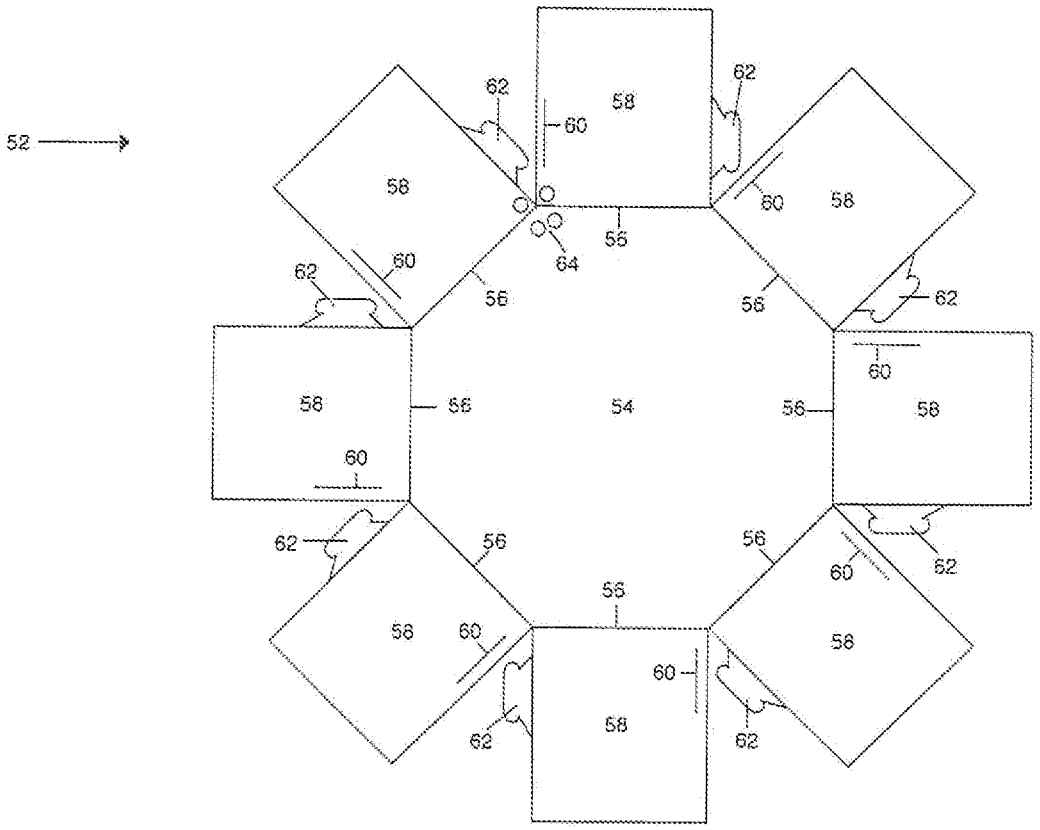
FIG. 13 is a plan view of a hang tag blank having eight end panels.
Figure 14:
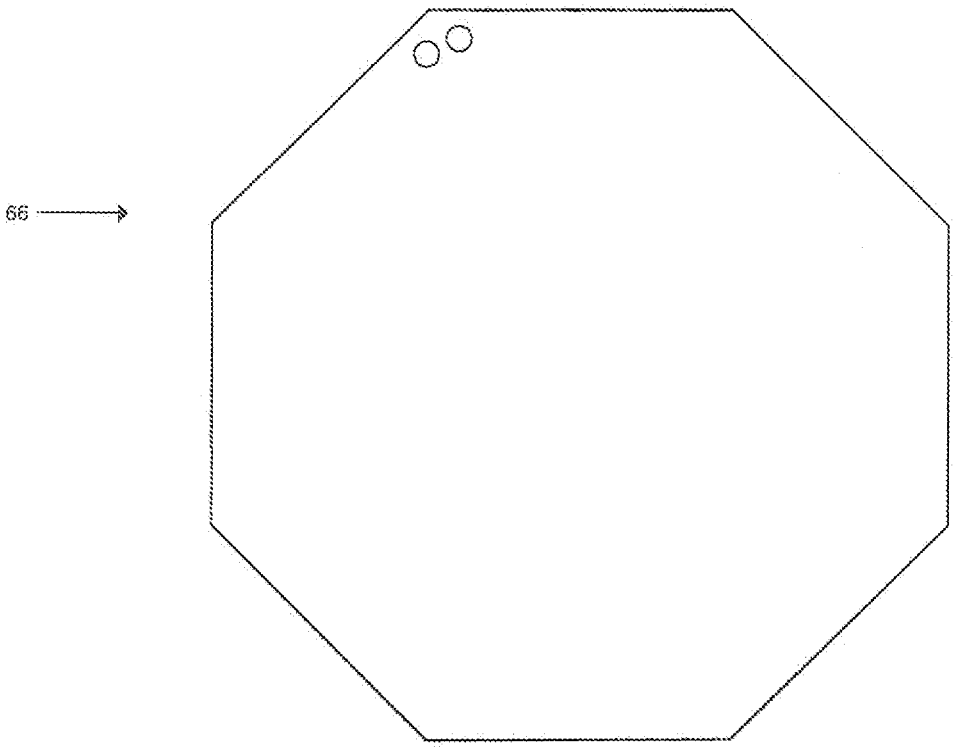
FIG. 14 is a front view of a first folded embodiment of the hang tag having eight end panels.

In further embodiments, the combination device can come in various shapes. FIGS. 13-14 show an octagonal combination device that can be folded into two separate folding embodiments. Blank 52 includes an octagonal front panel 54 having sides 56. At least one aperture 64 is cut into the front panel at a location near sides 56. Eight end panels 58 are attached to each side 56, creating fold lines at each side 56. Each end panel 58 includes at least one opening 60 and at least one tab 62. At least one of the end panels includes at least one aperture to overlap at least one aperture 64 on the front panel. As shown in FIG. 13, front panel 54 includes two aperture holes and two adjacent end panels 58 have one aperture each, such that when the end panels are folded toward each other, each aperture of the adjacent end panels cover one aperture of the front panel. In alternate embodiments, the apertures are in different locations on blank 52.

Functionally, FIG. 13 octagonal blank 52 is the same as blank 10 of FIG. 1. Each end panel 58 can be folded along fold lines 56 toward front panel 54 such that each end panel overlaps one adjacent end panel and is overlapped by an opposing adjacent end panel. This forms a first foldable embodiment that can be hung from a saleable item as a tag 66 as shown in FIG. 14. Tag 66 can be imprinted with any design desired such as a clothing logo. Alternatively, each end panel 58 includes at least one opening 60 and at least one tab 62 such that they can be interlocked together to form a storage area for the saleable item. In this embodiment, the storage area has a generally octagonal shape. As could be readily understood by one skilled in the art, the combination device can include substantially any number of sides greater than two and any known interlocking, mechanism known in the art such as a peel away strip can be utilized.

I create a method and apparatus for identifying an item of sale and storage of the item after purchase. Various changes and modifications can be made without departing from its scope or spirit. For example, each end panel does not have to be identical in shape, and can have varying lengths and widths as relative to each other.

While the preferred embodiments of my disclosure have been shown and described, it will be apparent to those skilled in the art that changes and modifications may be made therein without departing from the spirit of my disclosure, the scope of which is defined by the appended claims.

What is claimed is:

1. A hang tag convertible from a folded configuration to a storage container configuration, comprising:

a front panel having a multiplicity of sides;

at least three end panels hingedly attached to the sides of the front panel such that each side is hingeldy attached to at least one end panel, wherein each end panel includes at least one interlocking mechanism to interlock an adjacent end panel;

at least one front panel aperture in the front panel; and at least one end panel aperture in at least one of the end panels, wherein the at least one end panel aperture overlaps the at least one front panel aperture when the end panel containing the at least one aperture is hingedly folded toward the front panel, wherein all end panels are folded behind a front surface of the front panel when the hang tag is in the folded configuration.

2. The hang tag of claim 1, wherein each side of the front panel is hingedly attached to one end panel.

3. The hang tag of claim 2, wherein the interlocking mechanism of each end panel includes at least one opening and at least one tab extending outwardly from an edges thereof.

4. The hang tag of claim 1, wherein the front panel contains an imprinting.

5. The hang tag of claim 1, wherein the front panel contains two front panel apertures.

6. The hang tag of claim 5, wherein two adjacent end panels each have one end panel aperture.

7. The hang tag of claim 1, wherein the apertures of the front panel are substantially near at least one side.

8. The convertible hang tag of claim 1, wherein a first shape of the hang tag viewed from the top and a second shape of the storage container viewed from the top are substantially the same.

9. The convertible hang tab of claim 1, wherein a first shape of the hang tag viewed from the top is substantially circular and a second shape of the storage container viewed from the top are substantially the same.

10. The convertible hang tag of claim 1, wherein a first shape of the hang tag viewed from the top is substantially circular and a second shape of the storage container viewed from the top are substantially square.

11. The convertible hang tag of claim 1, wherein a diameter of the hang tag viewed from the top and a diameter of a storage container viewed from the top are substantially the same.

12. A hang tag for identification, comprising:

a front panel having a multiplicity of sides; at least three end panels hingedly attached to the sides of the front panel such that each side is hingeldy attached to at least one end panel, wherein each end panel includes interlocking means, wherein the front panel includes at least one front panel aperture and wherein the hang tag is attached to a saleable item via the aperture.

13. The hang tag for identification of claim 12, further comprising at least one end panel aperture in at least one of the end panels, wherein the at least one end panel aperture overlaps the at least one front panel aperture when the end panel containing the at least one aperture is hingedly folded toward the front panel.

14. A method for converting a hang tag made according to claim 12 into a storage container, comprising the steps of:

detaching the hang tag from a saleable item, unfolding the hang tag to provide a front panel having a multiplicity of sides and at least three end panels hingedly attached to the sides of the front panel; and interlocking the end panels together to form a storage area.

15. The method of claim 14, wherein the tag is removed from the item prior to unfolding it, the tag is attached to the item via at least one aperture in the tag.

16. The method of claim 14, wherein the storage area is stackable with another like storage area.

17. The method of claim 14, wherein the storage area is generally octagonal in shape.

18. The hang tag of claim 17 wherein the hang tag has a folded configuration, wherein the front panel is the entirety of a front surface of the hang tag when the hang tag is in the folded configuration.

19. The method of claim 14, wherein a first shape of the hang tag viewed from the top and a second shape of the storage area viewed from the top are substantially the same.

* * * * *